United States Patent [19]

Fredriksson et al.

[11] 3,970,264

[45] July 20, 1976

[54] REEL FOR STORING AN ELONGATED PLIABLE MEMBER

[76] Inventors: Henning Fredriksson, Angsgatan 24 B; Sven Åke Helde, Dalvindsgatan 3, both of Kungsbacka, Sweden

[22] Filed: Apr. 22, 1975

[21] Appl. No.: 570,370

[30] Foreign Application Priority Data

Apr. 24, 1974 Sweden ..... 7405479

[52] U.S. Cl. ..... 242/96

[51] Int. Cl.[2] ..... B65H 75/40

[58] Field of Search ..... 242/96, 84.8, 74

[56] References Cited

UNITED STATES PATENTS

| | | | |
|---|---|---|---|
| 2,683,000 | 7/1954 | Beiderwell | 242/96 |
| 2,982,491 | 5/1961 | Beiderwell | 242/96 |
| 3,053,472 | 9/1962 | Stewart | 242/96 |
| 3,078,058 | 2/1963 | Roe | 242/96 X |

*Primary Examiner*—Edward J. McCarthy
*Attorney, Agent, or Firm*—Holman & Stern

[57] ABSTRACT

A reel for storing an elongated, pliable member, especially a steel ribbon of the type being used for pulling electric cables through tubing, includes a bowl shaped main portion and a cover therefore. The cover is provided with an inwardly directed spigot in the body of which a part-circumferential (first) groove is provided for the reception of one end of the pliable member. To guide the introduction thereof the cover, on its outward face, is provided with a mark coinciding with the entrance to the said first groove in the spigot, and furthermore, on its inward face with a second groove, extending tangentially outwards from the said entrance. There is a passage opening in the side wall of the main portion, and from said passage opening a third groove in the bottom of the main portion runs inwards, directed as a tangent to the said first groove in the spigot.

4 Claims, 3 Drawing Figures

REEL FOR STORING AN ELONGATED PLIABLE MEMBER

BACKGROUND OF THE INVENTION

The present invention refers to reels used for storing ribbons or wires, preferably such pliable elongated members as are used for pulling electric cables through tubes of plastics or reinforced material being fitted into the walls and ceilings of buildings. Such members must be pliable, but simultaneously sufficient rigid to permit a pushing through considerable length of tubing, often passing several bends therein. These properties make the members difficult to handle, when not being located within the tubes. For practical reasons it is desirable that both ends of the member be free, and it should be very difficult to operate with a member, one end of which was permanently attached to a reel or some similar storing device.

SUMMARY OF THE INVENTION

The present invention refers to a reel for storing such elongated members, or other ribbons or wires, where it is desirable to be able, in a simple manner, occasionally to feed-in one end of the member, and then to wind the member home.

A reel according to the invention includes a main portion, a bottom and side wall having an internal cylindrical face extending therefrom, as well as a passage opening in said wall. The cover is provided with a centrally located cylindrical spigot, in mounted position, directed towards the bottom of the main portion, the spigot being provided with a groove for the reception of one end of the ribbon or wire, respectively, said groove extending from an entrance in the side wall of the spigot, peripherally along said wall over an angle being at least 180°, but not exceeding 360°. A mark coinciding with the entrance to the spigot, is provided in the outwardly turned face of the cover.

DESCRIPTION OF A PREFERRED EMBODIMENT

Figure 1:
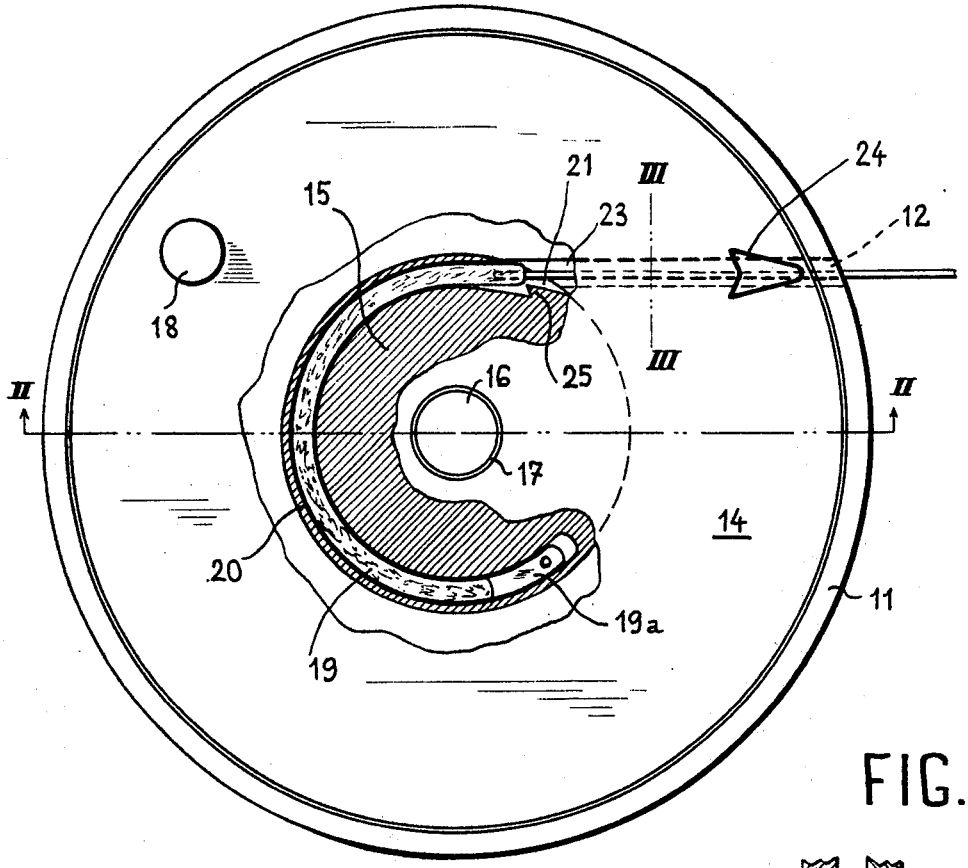
FIG. 1 shows the reel, as viewed from its lid and with a portion cut away.
Figure 3:
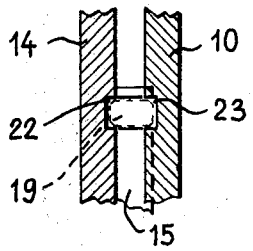
FIG. 3 shows a detail of a section along line III — III in FIG. 1.
Figure 2:
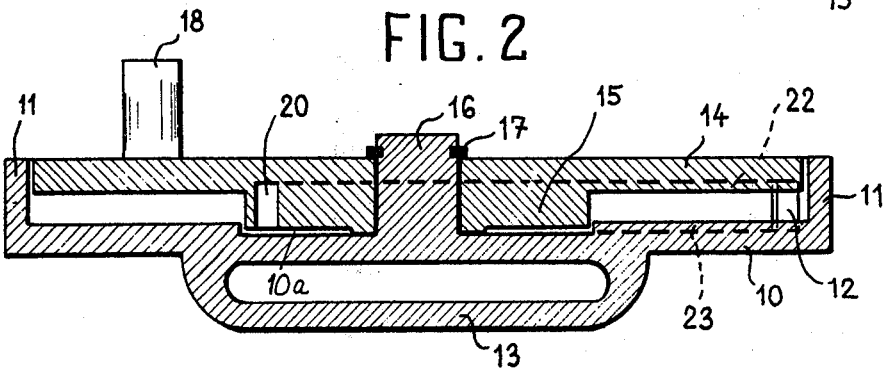
FIG. 2 shows a section along line II — II in FIG. 1.

The main portion of the reel includes a bottom 10 and a side wall 11, having at least an inward face of cylindrical shape. A passage opening 12 is provided in this side wall, and the outer face of the bottom is formed as a handle 13.

A lid 14 is formed so as to fit into the bowl shaped recess formed by the bottom and the side wall of the main portion, and is furthermore provided with a centrally located spigot 15, which in mounted position will be directed towards the bottom of the main portion. A recess 10*a*, mating with the end of spigot 15, is formed in the bottom.

The spigot is formed with a central bore, and the bottom is provided with a mating peg 16. This is provided with a peripheral groove, located just outside the outer face of the cover, and a locking ring 17 is fitted into this groove.

This arrangement ensures that the cover is maintained at a distance from the bottom, suited to the breadth of the ribbon to be stored. The cover, furthermore, is provided with an external cranking handle 18, by means of which the cover may be easily rotated.

A ribbon of the type considered here usually has an almost elliptical cross section, and is at each end provided with a head 19, which is somewhat more pliable than the ribbon proper. The forward end of a head is terminated by a portion 19*a* having an opening, or being in other way made suitable for the temporary attachment of an electric cable. The head usually is somewhat thicker than the ribbon and may occasionally be shaped as a ball. In order to make possible a simple insertion of the ribbon into the reel, spigot 15 is provided with a groove 20, which, within the body of the spigot, extends peripherally along the side wall of the spigot, over a distance being at least 180°, but not exceeding 360°, from an entrance 21 in the said side wall.

To facilitate the introduction of the end of the ribbon the entrance 21 must be aligned with passage opening 12. The cover is provided with a groove 22 which extends from entrance 21, tangentially outwards, and the bottom is provided with a corresponding groove 23, which from passage opening 12 in the side wall, runs inwards directed as a tangent to groove 20 in the spigot. The face of the cover is provided with mark 24, the end of which coincides with the end of groove 22 in the cover.

When it is desirable to wind home a ribbon the cover is rotated so mark 24 will coincide with passage opening 12, whereupon one head of the ribbon is pushed into the reel. The head is guided by grooves 22 and 23 straight towards entrance 21, but will be deflected along groove 20 upon entering the spigot. When the head has reached the bottom of the groove the friction will be sufficient to retain the ribbon at the spigot, and it is possible to start rotating the cover. In order to facilitate a retention of the head 19, 19*a* of the ribbon, spigot 15, adjacent to entrance 21, is formed with a detent 25.

The diameter of spigot 15 is preferably selected in such a manner, that the groove will obtain sufficient length to receive all of the head, so a portion of the ribbon proper will be located within the entrance when the cranking is started.

A further advantage is also obtainable with the invention. A considerable pulling effort is necessary to make free a ribbon which has stuck in a tube. In order to obtain a secure grip upon the ribbon a cutting plier is often used, which however will damage the ribbon. By turning the main portion of the reel somewhat with respect to the longitudinal direction of the ribbon and holding the cover securely, it is possible to lock the ribbon within passage opening 12. This will provide a satisfactory leverage to make possible a pulling out of the ribbon without damaging the same.

What we claim is:

1. In a reel for storing an elongated, pliable member and including a bowl shaped main portion provided with a bottom, a side wall having an internal cylindrical face extending therefrom, a passage opening in said side wall, and a cover for mounting on and closing the main portion provided with a centrally located spigot having a cylindrical body, said spigot body extending towards the bottom of the main portion when said cover is in mounted position on said main portion and defining with said cylindrical face an annular space for storing said pliable member, the improvement comprising said spigot defining a first groove internally thereof for the reception of one end of the pliable member, said first groove communicating with said annular space through an opening defined in the outer wall of said spigot body and extending from said opening peripherally along said spigot wall over an angle of at least 180°but not exceeding 360°, and a mark coinciding with said opening in the face of the cover which is outwardly turned when said cover is mounted on said body portion.

2. The reel according to claim 1, in which the cover is provided with a second groove which extends from said opening tangentially outwards to the periphery of the cover and the bottom of the main portion is provided with a third groove which extends from the passage opening in said side wall inwardly and tangentially to the first groove in the said spigot.

3. The reel according to claim 1 in which the spigot adjacent to the said entrance is formed as a detent.

4. The reel according to claim 1 in which the main portion is provided with a guide for the cover, said guide including a centrally located peg adapted, in mounted position, to extend through a mating bore in the spigot and a recess in the bottom of said main portion for receiving the spigot.

* * * * *